United States Patent [19]

Bart

[11] 4,064,845

[45] Dec. 27, 1977

[54] METERING VALVE FOR PILOT FUEL INJECTION

[75] Inventor: Hansueli Bart, Whitehall, Mich.

[73] Assignee: Eaton Corporation, Cleveland, Ohio

[21] Appl. No.: 625,411

[22] Filed: Oct. 22, 1975

[51] Int. Cl.[2] ..... F02M 45/02; F02D 1/12

[52] U.S. Cl. ..... 123/32 G; 123/139 AQ; 123/139 AP; 137/625.13; 251/263

[58] Field of Search ..... 123/32 G, 139 AQ, 139 AP; 137/625.13, 625.68; 251/263

[56] References Cited

U.S. PATENT DOCUMENTS

| | | | |
|---|---|---|---|
| 2,174,526 | 10/1939 | Parker | 123/139 AP |
| 2,974,657 | 3/1961 | Bessiere | 123/32 G |
| 3,439,655 | 4/1969 | Eyzat | 123/32 G |
| 3,648,673 | 3/1972 | Knape | 123/139 AP X |
| 3,758,241 | 9/1973 | Eheim | 123/139 AP X |
| 3,990,413 | 11/1976 | Pischinger | 123/32 G |

FOREIGN PATENT DOCUMENTS

| | | | |
|---|---|---|---|
| 960,760 | 11/1949 | France | 123/32 G |

*Primary Examiner*—William R. Cline
*Attorney, Agent, or Firm*—Teagno & Toddy

[57] ABSTRACT

A valve assembly for a pilot fuel injection system, which system also includes a transfer pump, a high pressure fuel pump, and a fuel injection nozzle. The valve assembly includes a blocking valve and a metering valve in an unitary housing having a high pressure fuel inlet, a metered fuel outlet, and a fuel return outlet. The blocking valve includes a cam ring operating a spool type valving member which opens and closes the high pressure inlet to the metering valve in a timed phase relation with an engine. The metering valve includes a cam ring, a spool type valving member, a spring, and a dump means. The cam ring has a single lobe which smoothly increases on one side and abruptly decreases in two steps on the other side; the smooth side slides the spool in one direction at velocities proportional to engine speed while the inlet is closed by the blocking valve; and the spring moves the spool along a two stepped path at velocities independent of engine speed while the inlet is open. The spool meters a pilot charge to the metered fuel outlet during the second step. The dump means connects the metered fuel outlet to return at some point during the second step, thereby terminating the flow of the main charge to the engine. Spool rotating means responsive to throttle position vary the dump means connecting point, thereby varying the main fuel charge amount flowing to the engine. An alternative embodiment of the stepped cam ring comprises two concentric and relatively moveable rings for varying the timing of the charges with respect to each other and the engine.

42 Claims, 9 Drawing Figures

48
152
90
154
88
148
146
146b
150
98
146a
158
156
99
70
70b
97
144
86
97b
142
82
162
142a
140
84
32
138
115
160
42a
95
116
70a
118
74a
92a
100
80
79
66
102
78
76
3A
96
124
164
94
106
122
64
112
106
72
114
126
128
72a
108
74
120
130
42a
104
130a
136
132
56a
130b
110
134
55
52
54
56b
58
56
60
62
46a
42c
50
46
47
47a
47a

FIG. 3A.
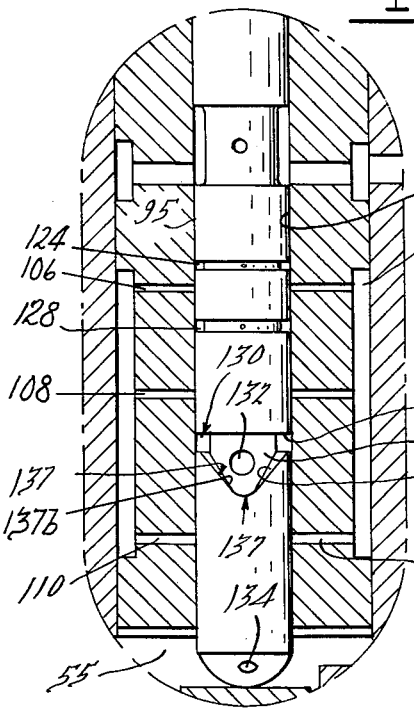
FIG. 4.
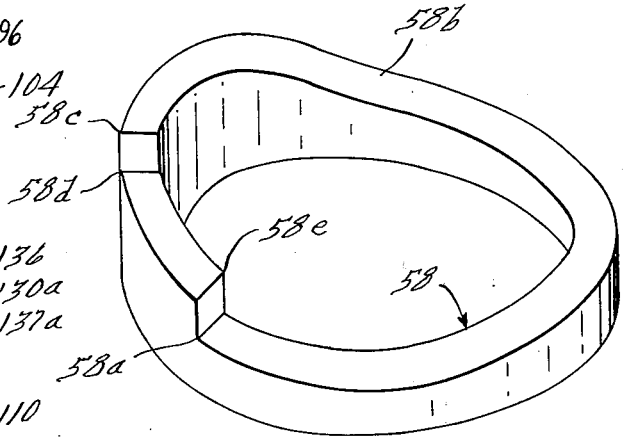
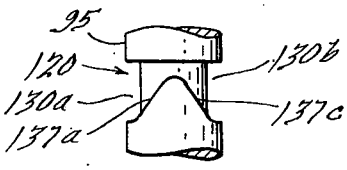
FIG. 3B.
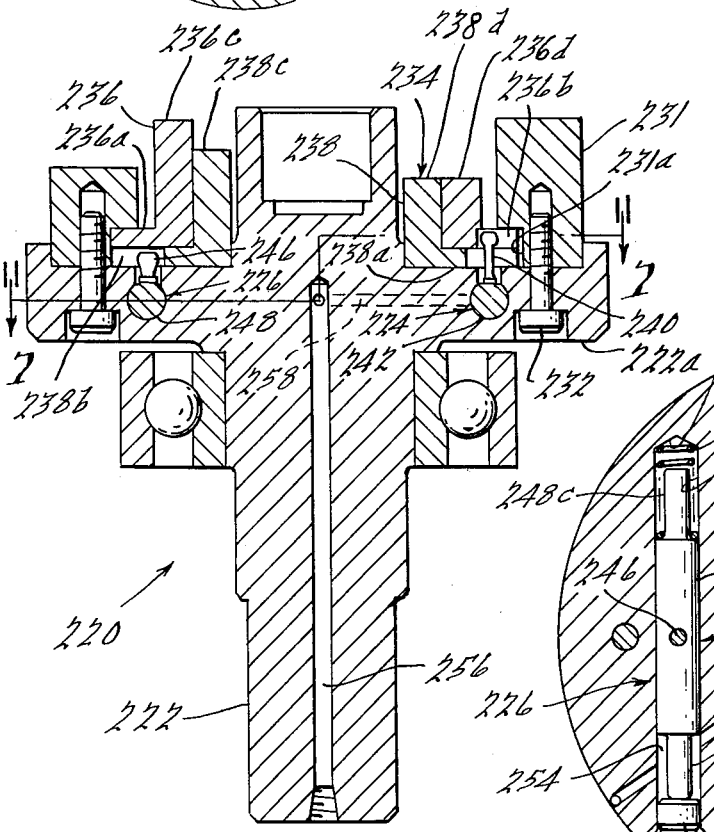
FIG. 7.
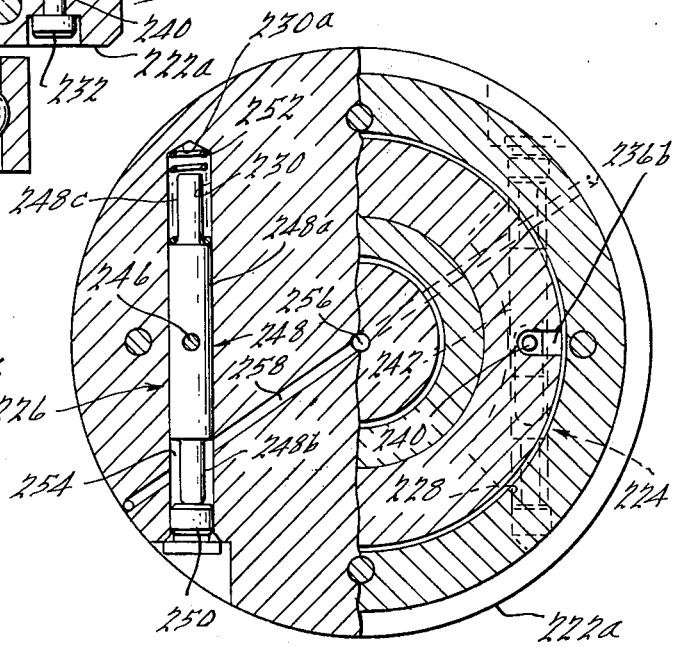
FIG. 6.

METERING VALVE FOR PILOT FUEL INJECTION

CROSS-REFERENCE

This application is related to copending application Ser. No. 609,884 filed Sept. 2, 1975 and assigned to the assignee of this application.

BACKGROUND OF THE INVENTION

1. Field of the Invention

This invention relates to a pilot fuel injection system for an internal combustion engine and more specifically to a metering valve for such a system.

2. Description of the Prior Art

The advantages of fuel injection are well known. The degree with which the advantages are obtained is governed greatly by the accuracy and timing flexibility of the metering valve or valves in an injection system and ultimately by the cost of the metering valves and system for controlling the valves. As injection system metering valve for a compression ignition engine should meter the quantity of fuel demanded for engine speed and load, should meter an equal quantity to each cylinder at the optimum time and rate, and should sharply control injection pressure rise and fall to the injection nozzle to avoid nozzle dribble and after injection.

Several different basic types of fuel injection systems have been devised. The most successful of the basic types have been the common rail system and the jerk pump system. Many variations and combinations of the basic systems have also been devised. The basic common rail system employs a single pump for maintaining injection pressure to a commom header and one or more metering valves. The rate of fuel metering in such systems is a function of time, since injection pressure is constant. The basic jerk pump system employs one or more jerk pumps which provide both the injection pressure and the metering. The rate of fuel injection in such systems is relatively constant with respect to degrees of engine crankshaft rotation; however, this rate varies greatly with respect to time; and therefore, the pressure varies greatly with respect to engine speed.

During the past several years common rail systems have had decreasing success with compression ignition engines operating over a wide speed and load range. Compression ignition engines require high injection pressures. The known types of metering valves capable of accurately metering the high pressure fuel have required actuating forces which are relatively high and synchronized. Engine driven actuating mechanisms provided both. However, they also operate the valving members in the metering valves at speeds proportional to engine speed, i.e., increasing engine speeds cause increasing valving member speeds with respect to time, thereby undesirably reducing the quantity of fuel metered, since metering rate is a function of time in such systems. Varying the size of the metering orifice in the valve as a function of engine speed and load was one method of maintaining and/or increasing the quantity of metered fuel. This method was costly and complex, as were the many other methods tried. Common rail systems have had a rather high degree of success with spark ignition engines, since such engines require a relatively low pressure for manifold injection, whereby the conventional metering valves may be actuated by a solenoid producing relatively low forces.

Injection systems employing jerk pumps, which combine pumping and metering into a single unit, have had a high degree of success with diesel engines. Such systems may have one combined unit supplying several engine cylinders via a distributor or one unit per engine cylinder. In either case the unit often includes a piston and a bore defining a chamber which is expanded and contracted in response to reciprocating movement of the piston. The piston is reciprocated by an engine driven cam at speeds proportional to engine speed. A variable volume of fuel is trapped in the expanded chamber and then impulsively pushed to an engine cylinder in response to the piston moving in a direction contracting the chamber. Such units have several disadvantages. High forces are required to raise the trapped fuel volume to the high injection pressure required for a diesel engine. The drive train between the piston and the engine must be designed to withstand high torques. If variable injection timing is required, the drive train must include a sturdy phase change mechanism capable of withstanding the high torques. The high driving forces causes side loading of the piston, thereby accelerating wear of the piston and the bore. Injection pressures are lower than ideal at low engine speeds and higher than ideal at high engine speeds, since the piston is proportional to engine speed. Leakage of fuel from the trapped volume increases with decreasing engine speed. Rise and fall of the injection pressure is rather slow due to the cyclic pumping of the fuel by the piston.

Most fuel injection systems for compression ignition engines inject a single fuel charge per compression stroke; some systems, known as pilot or two stage systems, inject a small pilot or precharge of fuel early in the compression stroke. The pilot charge may be injected 30° to 60° bTDC and is followed by a main charge close to TDC. Methods and advantages of pilot injection have been described by many: Dr. P. H. Schweitzer in "What Can be Gained by Pilot Injection" Automotive Industries, Vol. 79 (1938) pp 533–534; Monnot et al in U.S. Pat. No. 2,966,079; and P. Eyzat in U.S. Pat. No. 3,439,655. Dr. Schweitzer's article points out some of the advantages obtainable with pilot injection, e.g., elimination of the characteristic diesel knock by reducing the rate of cylinder pressure rise per degree of crankshaft rotation, lower peak cylinder pressure, increased power output, and a reduction in fuel consumption per horsepower hour. Dr. Schweitzer also identifies a problem encountered when attempting to reduce the pilot fuel injection concept to practice; specifically, providing a fuel metering valve which accurately meters a stable pilot charge over the full operating range of the engine.

Since Dr. Schweitzer's contributions, researchers have confirmed the stated advantages of the pilot fuel injection concept and in addition have discovered that the concept can be used to reduce pollutant exhaust emissions, such as oxides of nitrogen, while retaining the stated advantages. However, the task of economically producing a pilot fuel injection system which provides an accurate and stable pilot charge has proven to be even more difficult than the task of producing a single charge injection system.

U.S. patent application Ser. No. 403,308, filed Oct. 3, 1973 now abandoned and assigned to the assignee of this application, discloses a solenoid actuated spool type valve capable of metering very small and accurate pilot and main fuel charges to the cylinders of an engine. The valve of application Ser. No. 403,308 employs the concept of metering fuel only while momentarily defining a continuous passage through the valve by traversing a passage in the spool across an outlet passage in the housing. The spool velocity is independent of engine speed and the velocity is preferably the same for all engine speeds and loads. Further metering is started and stopped without reversing the spool velocity by completely traversing the passage. The traversing concept allows very small and accurate metering of the fuel charges. The features of the same spool velocities for all engine conditions and not reversing direction of the spool during metering (i.e., traversing) allows the use of simple and inexpensive means to control movement of the spool. Further, since direction of the spool is not reversed during metering, spool actuating forces are maintained relatively low. This improves the wear life of the valve, since high actuating forces adversely effect long wear life.

U.S. patent application Ser. No. 603,078, filed Aug. 8, 1975 and assigned to the assignee of this application, discloses an improved means for controlling the amount of fuel metered by the valve of application Ser. No. 403,308.

The valve of this application discloses improved means for actuating and controlling the amount of fuel metered by the valves of applications Ser. Nos. 403,308 and 603,078.

SUMMARY OF THE INVENTION

An object of this invention is to provide a simple and low cost fuel metering valve for a pilot fuel injection system.

Another object of this invention is to provide a fuel metering valve which is readily controlled to provide pilot and main fuel charges in a timed relation to the engine.

Another object of this invention is to provide a fuel metering valve which is readily controlled to vary the timing of the pilot and main fuel charges metered to the engine.

Another object of this invention is to provide a fuel metering valve which is readily controlled to terminate the flow of metered fuel to the engine and to vary the volume of metered fuel flowing to the engine.

According to a feature of this invention, the fuel metering valve includes a valve housing having a bore, fuel inlet and outlet passages opening into the bore, a spool type valving member slideably disposed in the bore and having passage means operative to meter a pilot and a main fuel charge in response to the spool moving along a stepped path from a first position to a second position, a cam having a lobe smoothly increasing on one side and abruptly decreasing in two steps on the other side, and a means biasing the spool against the lobe. The cam is driven in a timed relation with the engine; the smooth side moves the spool to the first position at velocities proportional to engine speed and the steps allow movement of the spool along the stepped path by the biasing means at velocities independent of engine speed.

According to another feature of the invention the angular phase relation of the spool and lobe is varied relative to the engine to vary the timing of the pilot and main fuel charges.

According to another feature of the invention, the steps are varied with respect to each other to vary the timing of the pilot and the main charges with respect to each other.

According to another feature of the invention, the fuel outlet passage is connected to a return at some point during spool movement along the stepped path, thereby lowering the fuel pressure in the outlet and terminating the flow of metered fuel to the engine.

According to another feature of the invention, the spool is rotated by the engine throttle to vary the point the outlet is connected to return during spool movement, thereby varying the volume of metered fuel flowing to the engine.

BRIEF DESCRIPTION OF THE DRAWINGS

The preferred embodiments of the invention are shown in the accompanying drawings in which:

FIGS. 3A and 3B are additional views of a portion of the metering valve in FIG. 3;

FIG. 4 is a perspective view of a cam ring in the valve assembly;

FIG. 6 is a cross-sectional view of a second embodiment of an input shaft and cam assembly of FIG. 3; and FIG. 7 is a cross-sectional view of the input shaft and cam assembly looking in the direction of arrows 7—7 in FIG. 6.

DESCRIPTION OF SYSTEM IN FIG. 1

Figure 1:
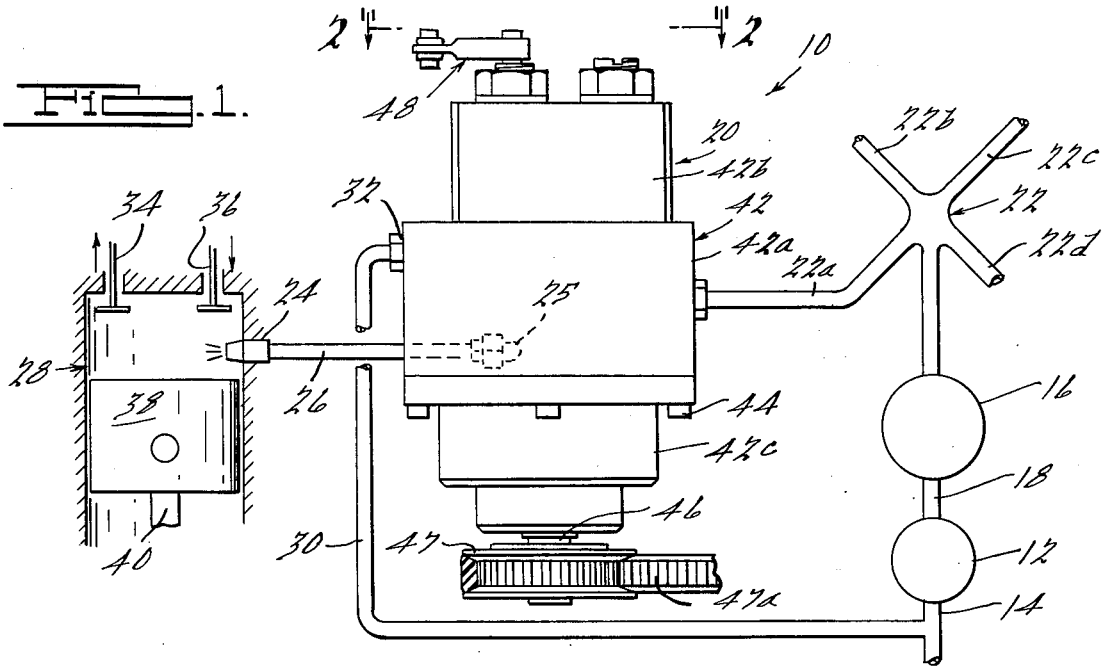
FIG. 1 is a somewhat schematic view of a portion of a pilot fuel injection system employing a valve assembly for metering pilot and main fuel charges to an engine cylinder.

FIG. 1 is a somewhat schematic view of a pilot fuel injection system 10 having a fuel transfer pump 12 connected by an inlet conduit 14 to a source of fuel (not shown), a high pressure fuel pump 16 connected by a conduit 18 to the outlet of the transfer pump, a valve assembly 20 connected by a branch **22*a* of a manifold 22 to the outlet of the high pressure fuel pump, a fuel injecting nozzle 24 connected to a metered fuel outlet port 25 in valve 20 by a conduit 26, and a cylinder 28 of an unshown compression ignition engine. Branches 22*b*, 22*c*, and 22*d* of manifold 22 supply fuel to additional valves 20. A conduit 30 connects a return port 32 of valve 20 to the inlet conduit 14. Valve 20** is shown enlarged relative to the other components in the system to more clearly show its exterior detail.

Pumps 12 and 16 and nozzle 24 may be any of several types which are well known in the art. Pumps 12 and 16 are preferably engine driven. The high pressure supplied by pump 16 may be in the order of 4,000 to 10,000 psi. The term high pressure, as used herein, distinguishes the high pressure required for fuel injection into an engine cylinder of a compression ignition engine over the relatively low pressure required for fuel injection into a manifold of an Otto cycle engine. Nozzle 24 injects directly into cylinder 28. Cylinder 28 includes inlet and exhaust valves 34 and 36, respectively, and a piston 38 driven by an unshown crankshaft via a connecting rod 40.

VALVE DESCRIPTION

Figure 2:
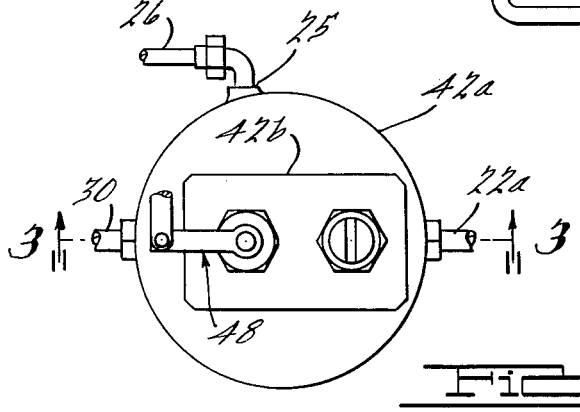
FIG. 2 is an end view of the valve assembly in FIG. 1 looking in the direction arrows 2—2 in FIG. 1 and showing a blocking valve and a metering valve in the valve assembly.

Valve 20 includes a housing 42 having a round body portion 42a formed integrally with a rectangular portion 42b which is best seen in FIG. 2, an end portion 42c secured to the body portion by screws 44, an input shaft 46 preferably engine driven by a pulley 47 and a cog belt 47a, and linkage means 48 adapted to be connected to the engine throttle for controlling the amount of fuel metered by the valve.

Figure 3:
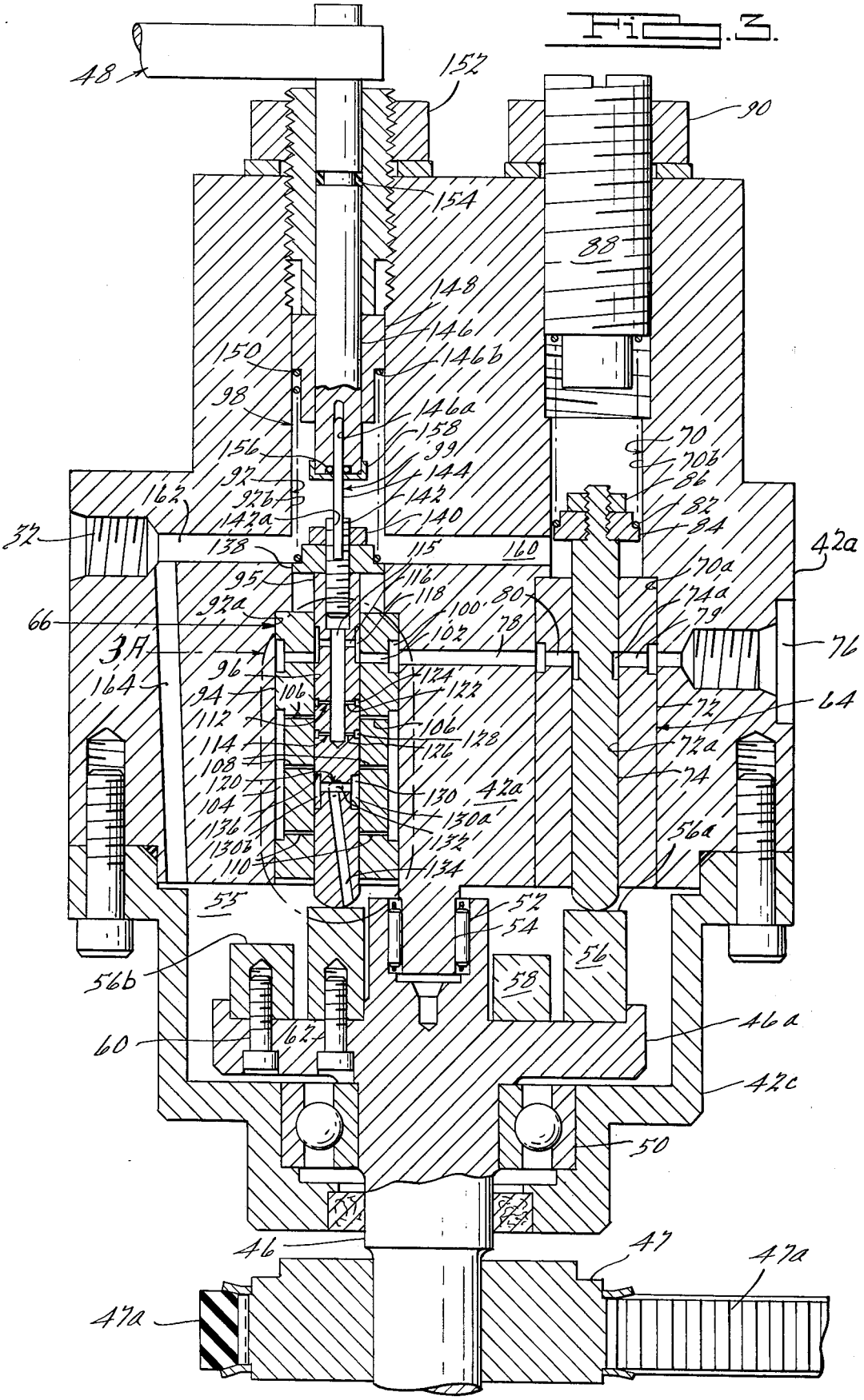
FIG. 3 is a cross-sectional view of the valve looking in the direction of arrows 3—3 in FIG. 2.

The valve assembly, as seen in FIG. 3, includes the shaft 46 rotatably supported by a bearing 50 in housing end portion 42c and a bearing 52 carried by a projection 54 of housing body portion 42a which extends into a chamber 55 defined by end portion 42c, two axially facing cam rings 56 and 58 secured to a flange portion 46a of the shaft 46 by screws 60 and 62, a blocking valve 64 actuated by cam ring 56, and a metering valve 66 actuated by cam ring 58.

Blocking valve 64 includes a stepped bore 70 having bore portions 70a and 70b, a sleeve 72 pressed into bore portion 70a and defining a bore 72a, a spool type valving member 74 having an annular groove 74a for periodically communicating high pressure fuel from an inlet port 76 to an intermediate inlet passage 78 via passages 79 and 80 in the sleeve, and a spring 82 for biasing the spool toward cam ring 56. Spring 82 reacts between a stepped washer 84 secured to the spool by a nut 86 and a threaded rod or plug 88 which also provides a means for adjusting the biasing force of the spring. A jam nut 90 locks the rod in place.

Metering valve 66 includes a stepped bore 92 having bore portions 92a and 92b, a sleeve 94 pressed into bore portion 92a and defining a bore 96 slideably receiving a spool type valving member 95 biased toward an actuated or second position in the direction of cam 58 by a spring means 98 and moved to a cocked or first position by cam 58, and spool rotating means 99 for varying the angular position of the spool in bore 96 in response to movement of the linkage means 48 by the throttle. Bore 96 communicates with intermediate passage 78 via an annular groove 100 and a plurality of radially extending passages 102. Bore 96 also communicates with a second annular groove 104 via a pair of pilot metering passages 106, a pair of main metering passages 108, and a pair of dump passages 110. The second annular groove 104 communicates directly with the metered fuel outlet port 25 via an unshown passage.

Spool 95 includes a pilot metering passage means 112 and a main metering passage means 114 which communicate with passages 102 via a tubular chamber 115, a plurality radially extending passage 116, and an annular groove 118; spool 95 also includes fuel dump means 120. Pilot metering passage means 112 includes a plurality of radially extending passages 122 and an annular groove 124. Main metering passage means includes a plurality of radially extending passages 126 and an annular groove 128, which is approximately twice as wide as groove 124. Annular grooves 124 and 128 traverse, respectively, the cross-sectional opening areas of pilot and main metering passages 106 and 108 in response to movement of the spool between its first and second positions. The cross-sectional areas of passages 106 and 108, where they open into bore 96, are sized in combination with the width of grooves 124 and 128 to provide a pilot fuel charge about 10 percent of the main fuel charge. However, the pilot charge may vary over a range of 5 to 35 percent depending on the engine model and its use.

Fuel dump means (as seen in FIGS. 3, 3A and 3B) includes a cavity 130 formed in the circumferential surface of spool 95. The cavity is connected with chamber 55 via interconnected passages 132 and 134. The lateral side walls defining cavity 130 include a shoulder 136 which is straight in the axial direction of the spool and a saw toothed shoulder 137 having oblique shoulder portions 137a and 137b on the shown side of the spool in FIG. 3A and like shoulders on the other side of the spool. The saw toothed shoulders divide the cavity into two somewhat triangular shaped cavity portions 130a and 130b. The dump means connects annular grooves 104 to return when saw toothed shoulder 37 uncovers passages 110, thereby terminating the flow of metered high pressure fuel to the engine by abruptly dumping or lowering the pressure in groove 104. The angular position of the spool in bore 96 determines the point at which passages 110 are uncovered by saw tooth shoulder 137. The point may be before, during, or after groove 128 traverses passages 108. The angular position of the spool in FIG. 3 is such that the point occurs before the traversing, whereby none of the main charge flows to the engine. The angular position in FIG. 3A is such that the point occurs just after the traversing, whereby a maximum main charge flows to the engine. The amount of the main charge flowing to the engine is varied between none and the maximum when the angular position is between the positions of FIG. 3 and 3A.

Spring means 98 and spool rotating means 99 include a stepped washer 138 secured by a nut 140 to a threaded stud 142 which also plugs tubular chamber 115, a plate 144 pinned at one end in a slot 142a of stud 142 and slideably received at the other end in a slot 146a of a shaft 146. Shaft 146 is rotatably supported in a threaded bushing 148. A spring 150 reacts between stepped washer 138 and a shoulder 146b defined by shaft 146. Bushing 148 also provides means for adjusting the biasing force of spring 150 and is locked in place by a jam nut 152. An o-ring seal 154 prevents leakage along shaft 146. Frictional drag and free play of plate 144 in slot 146a is minimized by a set of roller bearings 156 which are held in place by a slotted cap 158.

Bore portions 70a and 92b are connected to return port 32 via passages 160 and 162. Chamber 55 is connected to return port 32 via passage 164.

Cam ring 58, as seen in FIG. 4, includes a substantially flat portion having an angular length of about 240° between 58a and 58b, a lift or lobe portion having an angular length of about 90° between 58b and 58c, a first step starting at 58c and dropping to 58d, a substantially flat portion having an angular length of about 30° between 58d and 58e, and a second step starting at 58e and dropping to 58a. The lobe between 58b and 58c moves the metering valve spool 95 to its cocked or first position, as shown. The first step allows the spool to move, under the force of spring 150, far enough for groove 124 to traverse passages 106; and the second step allows the spool to move, under the force of spring 150, far enough for groove 128 to traverse passage 108.

Cam ring 56, as seen in FIG. 3 has a single lobe or lift portion 56a and low dwell portion 56b. Lobe 56a has a crest which is long enough to maintain the blocking valve spool 74 in the unblocking position a few degrees before and after spool 95 is allowed to move along the stepped path allowed by the cam steps. Dwell portion 56b allows spring 82 to move spool 74 to its blocking position long enough for the lobe of cam 58 to move spool 95 to its first position.

The timing of the fuel pulses metered to the engine may be varied by changing the angular phase timing of input shaft 46 with a timing control mechanism such as disclosed in U.S. Pat. No. 3,496,918.

DESCRIPTION OF FIG. 5

Figure 5:
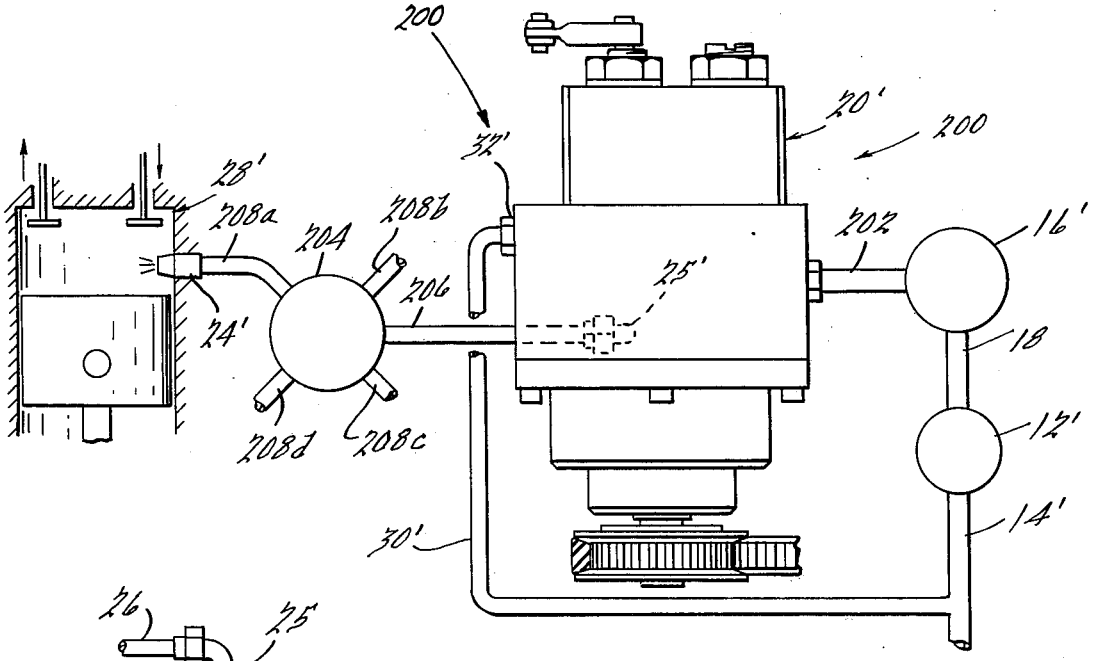
FIG. 5 is a somewhat schematic view of a second pilot fuel injection system employing the valve assembly.

FIG. 5 is a somewhat schematic view of a second pilot fuel injection system 200 employing metering valve 20'. The principle difference between systems 10 and 200 is the number of metering valves required for a multicylinder engine. System 10 employs one metering valve per cylinder; system 200 employs one metering valve for several cylinders. Components of the two systems differ mainly with respect to their position in the system. Components of system 200 which are per se the same as components of system 10 are designated with like numerals followed by a prime.

Injection system 200 includes a transfer pump 12' connected by an inlet conduit 14' to a source of fuel (not shown), a high pressure fuel pump 16' connected by a conduit 18' to the outlet of the transfer pump, a fuel metering valve 20' connected by a conduit 202 to the outlet of the high pressure fuel pump, a fuel distributor 204 connected to a metered fuel outlet port 25' in the metering valve by a conduit 206, a fuel injecting nozzle 24' connected to an outlet of the distributor via a conduit **208*a*, and a cylinder 28' of an unshown compression ignition engine. A conduit 30' connects a return port 32' of valve 20' to the inlet conduit 14'. Conduits 208*b*, 208*c*, and 208*d* emanating from distributor 204** supply fuel to other engine cylinders in the proper order.

Distributor 204 may be of the well known type having a fixed disc with a plurality of fuel outlet ports connected to the conduits **208*a*–208*d* and a rotating disc with a single port in constant communication with the metered high pressure fuel in conduit 206. The rotating disc, which is preferably engine driven, is driven in a timed phase relation with the metering valve and the engine. The inlet port traverses the outlet ports and pressurizes the tubes 208*a*–208*d*** in the engine firing order.

The blocking valve 64' in metering valve 20' may be dispensed with since distributor 204 may be used to block fuel pulses metered to outlet 25 during movement of spool 95 to its first position by cam 58.

The timing of the fuel pulses metered by valve 20' may be varied by the previously mentioned timing control mechanism disclosed in U.S. Pat. No. 3,496,918.

DESCRIPTION OF FIGS. 6 and 7

The shaft and cam arrangement 220 of FIGS. 6 and 7 may be inserted into valve assembly 20 in lieu of input shaft 46 and cams 56 and 58 to provide means within the valve assembly for varying the timed phase relation of the pilot and main fuel charges with respect to each other and with respect to the engine in response to variations in engine speed. Arrangement 220 includes an input shaft 222 having a flange portion **222*a*, piston assemblies 224 and 226 disposed in bores 228 and 230, respectively, a blocking cam 231 fixed to the flange by screws 232, and cam assembly 234**.

Cam assembly 234 includes an outer ring 236 having a flange portion **236*a* and an inner ring 238 having a flange portion 238*a*. Flange portion 236*a* is provided with a radially extending slot 236*b* which receives a pin 240 secured to a piston 242 of piston assembly 224. Flange portion 238*a* is also provided with a radially extending slot 238*b* which receives a pin 246 secured to a piston 248 of piston assembly 226. Flange portions 236*a* and 238*a* are slideably received by an annular notch 231*a* in blocking cam 231**.

Outer and inner rings 236 and 238 combine to define a ring similar to cam ring 58, i.e., a cam ring having a single lobe or lift, first and second steps, and a flat run between the steps. The inner ring includes a raised flat run **238*c* having an angular length of about 60° and a dropped flat run 238*d* having an angular length of about 300°. The change in height of runs 238*c* and 238*d* define the second step. The outer ring includes the lobe or lift which smoothly increases to a maximum height 236*c* over an angular distance of about 90°. The maximum height 236*c* steps down, via a single step equivalent to both steps of cam ring 58, to a flat run 236*d* having an angular length of about 270°. The single step of ring 236 and the raised flat run 238*c* of ring 238 define a first step equivalent to the first step of cam ring 58**.

Spool 95 of metering valve 66 is moved to its first or cocked position by the lobe on ring 236. The single step, defined by ring 236 and raised flat run **238*c*, allows the spool to move, under the force of spring 150, far enough to meter a pilot charge. The spool rides raised flat run 238*c*** to the second step, which second step then allows the spool to move far enough to meter a main fuel charge.

Piston assemblies 224 and 226 rotate rings 236 and 238 with respect to each other and with respect to the input shaft, thereby controlling the angular phase relation of the steps with respect to each other and with respect to the engine. The piston assemblies are substantially the same structurally; hence, a description of one will suffice for both. Piston assembly 226 includes the bore 230 which is blind at one end **230*a* and sealed at the other end by a plug 250, the piston 248 having a central portion 248*a* in sliding-sealing contact with the bore and necked down ends 248*b* and 248*c*, and a spring 252 biasing the piston against plug 250**.

Necked down end **248*b* and bore 230 define an annular chamber 254 communicable via passages 256 and 258 with a fluid pressure which increases in response to increasing engine speed. Such a fluid pressure may be provided by a fuel transfer pump. Transfer pumps of this type are well known and one such pump is disclosed in U.S. Pat. No. 3,650,259. Piston assembly 224 has an identical annular chamber communicable with the fluid pressure in passage 256 via an extension of passage 258**.

The piston biasing springs of the piston assemblies bias the inner and outer rings, and the steps defined thereby toward a retarded angular phase relation with respect to TDC of the engine piston. When the pistons 242 and 248 are against their stops, the first step occurs about 15 1 degrees bTDC and the second step about 10° aTDC. As engine speed increases, the fluid pressure, suppliable by the transfer pump, increases, thereby advancing the relation of the steps with respect to TDC. The biasing force of the spring in piston assembly 224 is made less than the biasing force of the spring in piston assembly 226, thereby providing a greater advance of the first step. At maximum engine speed, the first step may advance to about 90° bTDC and the second step to about 10° bTDC.

A valve assembly for a pilot fuel injection system has been disclosed. The valve assembly includes metering valve 66 and a blocking valve 64. The metering valve includes a spool 95 moved to a first or cocked position by the lobe of a stepped cam at a speed proportional to engine speed while the blocking valve is preventing the flow of unmetered high pressure fuel to the metering valve. The first and second steps on the cam allow movement of the spool along a stepped path from the first spool position to the second spool position. The pilot charge is metered during spool movement allowed by the first step; the main charge is metered during spool movement allowed by the second step. Injection timing of the pilot and main pulses to the engine may be advanced or retarded in response variations in engine speed and in one embodiment the timing of the pilot and main pulse may be varied with respect to each other. Spring 150 moves the spool along the stepped path with an instantaneous velocity which is always the same and which is independent of engine speed and load, since the forces applied to the spool by spring 150 are always the same and independent of engine speed and load. Therefore, the traversing velocity of pilot and main metering passages 112 and 114 across the openings of passages 106 and 108, respectively, is always the same, whereby the amount of fuel metered for each traversing is always the same, since fuel pressure to passages 112 and 114 is constant.

The disclosed embodiments of the valve are for illustrative purposes only. Many variations are believed to be within the spirit of the inventive concepts in the disclosed embodiments. For example, the cams of valve assembly 20 have been shown with a single cam lobe, thereby requiring that the valve assembly input shaft be driven at four times the engine camshaft speed so that the metering valve can supply fuel to the four engine cylinders when placed in a system such as shown in FIG. 5. The same result can be obtained by providing a plurality of cam lobes, in this case four on each cam, and driving the input shaft at engine camshaft speed. The following claims are intended to cover the inventive portions of the disclosed embodiments and variations and modifications within the spirit of the invention.

What is claimed is:

1. A metering valve for a pilot injection system, said metering valve comprising:

a valve housing having fuel inlet and outlet port means and a bore communicating with said means;

a valving member moveable in said bore along a path extending from a first position blocking communication between said port means to a second position;

passage means in said valving member operative during movement of said valving member along said path to define a first continuous passage through said valve housing and then a second continuous passage through said valve housing as said valving member moves further along said path, said first and second continuous passages being defined by serially connecting said inlet port means, said passage means, and said outlet port means;

means biasing said valving member toward said second position; and means operative to move said valving member from said second position to said first position, thereafter operative to allow said biasing means to move said valving member along said path a distance sufficient to define said first continuous passage, thereafter operative to momentarily interrupt such biasing movement, and thereafter operative to allow further biasing movement of said valving member along said path a distance sufficient to define said second continuous passage.

2. The metering valve of claim 1, wherein said operative means includes:

cam means having a lobe smoothly increasing on one side and abruptly decreasing in two steps on the other side, said smoothly increasing lobe side operative to move said valving member from said second position to said first position in response to relative movement between said cam means and said valving member, and said steps operative to allow said biasing means to move said valving member along said path in response to continued relative movement between said cam means and said valving member.

3. The metering valve of claim 1, wherein said biasing means is a spring.

4. The metering valve of claim 2, wherein said cam means includes:

annular ring means defining said lobe on an axially facing end thereof.

5. The metering valve of claim 4, wherein said cam means includes:

first and second cam rings defining said smoothly increasing lobe and said two steps; and means for varying the distance between said two steps.

6. A metering valve for a pilot injection system, said metering valve comprising:

a valve housing having fuel inlet and outlet means and a bore communicating with said means;

a spool type valving member slideably moveable in said bore in stepped fashion along a path extending from a first position blocking communication between said means to a second position;

passage means in said spool operative during movement of said valving member along said path to define a first continuous passage through said valve housing and then a second continuous passage through said valve housing, said first and second continuous passages defined by serially connecting said inlet means, said passage means, and said outlet means;

cam means having a lobe smoothly increasing on one side and abruptly decreasing in two steps on the other side;

means biasing said spool toward said lobe;

drive means for effecting relative movement between said cam means and said spool, the smooth side of said lobe operative to slide said spool to said first position in response to said relative movement and the steps allowing sliding movement of said spool in stepped fashion along said path by said biasing means in response to continuing relative movement.

7. The metering valve of claim 6, wherein said cam means is a ring cam means and said drive means effects relative rotational movement between said ring cam means and said spool.

8. The metering valve of claim 7, further including:

means for varying the angular phase relation between said drive means and said ring cam means, whereby the sliding movement of said spool is varied with respect to the rotational timing of said drive means.

9. The metering valve of claim 6, wherein said cam means includes:

first and second rings defining said lobe and said drive means effects relative rotational movement between said spool and said rings.

10. The metering valve of claim 9, wherein said first ring defines the smoothly increasing side of said lobe and a first step of said two steps and said second ring defines the second step, and further including:

means varying the angular relation of said rings relative to each other for varying the angular distance between said steps, thereby varying the timing between said drive means and the defining of at least one of said continuous passages with respect to the rotational timing of said drive means.

11. The metering valve of claim 10, wherein said varying means varies the angular position of the second ring relative to the first ring.

12. The metering valve of claim 9, wherein said first ring defines the smoothly increasing side of said lobe and a first step of said two steps and said second ring defines the second step, and further including:

means varying the angular relation of said steps relative to each other and relative to said drive means, thereby varying the timing of the defining of said continuous passages relative to each other and the timing of the defining of said continuous passage relative to said drive means.

13. The metering valve of claim 6, wherein said passage means defined by said spool includes:

a pilot metering passage and a main metering passage and said first continuous passage is defined by said inlet means, said pilot metering passage, and said outlet means, and said second continuous passage is defined by said inlet means, said main metering passage, and said outlet means.

14. The metering valve of claim 13, wherein said outlet means includes:

an outlet port;

a first outlet passage communicating at one end with said port and at another end with said bore, said first continuous passage being defined by said inlet means, said pilot metering passage, said first outlet passage, and said outlet port; and a second outlet passage communicating at one end with said port and at another end with said bore, said second continuous passage being defined by said inlet means, said main metering passage, said second outlet passage, and said outlet port.

15. The metering valve of claim 6 further including:

a return means in said housing; and dump means for connecting said outlet means with said return port during movement of said spool along said path from said first position to said second position.

16. The metering valve of claim 15, wherein said dump means includes:

a cavity formed in the circumferential surface of said spool and operative to communicate said outlet means with said return means at some point during movement of said spool along said path.

17. The injection system of claim 15, wherein said dump means includes:

a depression formed in the circumferential surface of said spool and having a lateral side wall oblique to the axis of said spool, said depression operative to communicate said outlet means with said return means at some point during movement of said spool along said path; and means operative to vary the rotational position of said spool and oblique wall in said bore for varying the point along said path which said outlet means is communicated with said return means.

18. The metering valve of claim 6, wherein said spool includes:

stop means operative to arrest movement of said spool by said biasing means just before the end of said spool impacts said cam means.

19. An improved metering valve in a pilot injection system of the type including a source of pressurized fuel, a nozzle for delivering the fuel to a cylinder of an internal combustion engine, means for communicating the source with the nozzle, and periodic means for blocking and unblocking the communicating means in a timed relation to the position of the piston in the cylinder, said metering valve comprising:

a valve housing having a bore, fuel inlet means communicating at one end with said bore and connected at the other end to said source by said communicating means, and fuel outlet means communicating at one end with said bore and connected at the other end to said nozzle by said communicating means;

a spool type valving member slideably moveable in said bore in two stepped fashion along a path extending from a first position blocking communication between said inlet and outlet means to a second position;

passage means in said spool operative during movement of said valving member along said path to meter a pilot fuel charge to said outlet means during the first step of such movement and then a main fuel charge to said outlet means during the second step of such movement;

cam means having a lobe smoothly increasing on one side and abruptly decreasing in two steps on the other side;

means biasing said spool toward said lobe; and means driven at a velocity proportional to engine speed and effecting relative movement between said cam means and said spool in a timed relation with said periodic means, said smooth side operative to move said spool to said first position at velocities proportional to engine speed while said periodic means is blocking said communicating means, and said steps and said biasing means operative to move said spool in stepped fashion along said path at velocities independent of engine speed while said periodic means is unblocking said communicating means.

20. The metering valve of claim 19, wherein said cam means is a ring cam means and said drive means effects relative rotational movement between said ring cam means and said spool.

21. The metering valve of claim 20, further including:

means for varying the angular phase relation between said drive means and said ring cam means, whereby timing of said pilot and main charges are varied with respect to the position of said piston in said cylinder.

22. The metering valve of claim 19, wherein said cam means includes:

first and second rings defining said lobe and said drive means effects relative rotational movement between said spool and said rings.

23. The metering valve of claim 22, wherein said first ring defines the smoothly increasing side of said lobe and a first step of said two steps and said second ring defines the second step, and further including:

means varying the angular distance between said steps, thereby varying the timing between said pilot and main fuel charges.

24. The metering valve of claim 23 wherein said varying means varies the angular position of the second ring relative to the first ring.

25. The metering valve of claim 22, wherein said first ring defines the smoothly increasing side of said lobe and a first step of said two steps and said second ring defines the second step, and further including:

means varying the angular relation of said steps relative to each other and relative to said drive means, thereby varying the timing of said pilot and main fuel charges relative to each other and relative to the position of said piston.

26. The metering valve of claim 19, wherein said passage means defined by said spool includes:

a pilot metering passage operative to define a first continuous passage including said inlet means, said pilot metering passage and said outlet means for metering said pilot charge in response to movement of said spool along the first step of said stepped path; and a main metering passage operative to define a second continuous passage including said inlet means, said main metering passage means, and said outlet means for metering said main fuel charge in response to movement of said spool along the second step of said stepped path.

27. The metering valve of claim 26, wherein outlet means includes:

an outlet port;

a first outlet passage communicating at one end with said port and at another end with said bore, said first continuous passage being defined by said inlet means, said pilot metering passage, said first outlet passage, and said outlet port; and a second outlet passage communicating at one end with said port and at another end with said bore, said second continuous passage being defined by said inlet means, said main metering passage, said second outlet passage, and said outlet port.

28. The metering valve of claim 19 further including:

a return means in said housing; and dump means for connecting said outlet means with said return port during movement of said spool along said path from said first position to said second position, thereby lowering the pressure of the metered fuel in said outlet means and terminating the flow of said metered fuel to said injecting nozzle.

29. The metering valve of claim 28, wherein said dump means includes:

a cavity formed in the circumferential surface of said spool and operative to communicate said outlet means with said return means at some point during movement of said spool along said path.

30. The injection system of claim 28, wherein said dump means includes:

a depression formed in the circumferential surface of said spool and having a lateral side wall oblique to the axis of said spool, said depression operative to communicate said outlet means with said return means at some point during movement of said spool along said path; and means operative to vary the rotational position of said spool and oblique wall in said bore for varying the point along said path which said outlet means is communicated with said return means.

31. The injection system of claim 28, wherein said engine includes a throttle, and wherein the dump means of said metering valve includes:

a depression formed in the circumferential surface of said spool and having a lateral side wall oblique to the axis of said spool, said depression operative to communicate said outlet means with said return means at some point during movement of said spool along the second step of said path;

means for varying the rotational position of said valving member and said oblique wall in said bore in response to movement of said throttle, thereby varying the point said outlet is connected to said return as said spool moves along the second step of said path.

32. An improved metering valve in a pilot injection system of the type including a source of pressurized fuel, a nozzle for delivering the fuel to a cylinder of an internal combustion engine, means for communicating the source with the nozzle, and periodic means for blocking and unblocking the communicating means in a timed relation to the position of the piston in the cylinder, wherein said improved metering valve comprises:

a valve housing having a bore;

fuel inlet means communicating at one end with said bore and connected at the other end to said source by said communicating means, and fuel outlet means defining first opening means at one end communicating with said bore and connected at the other end to said nozzle by said communicating means;

a spool type valving member slideably moveable in said bore along a path extending from a first position to a second position;

passage means in said spool defining second opening means blocked from communication with said first opening means when said spool is in said first and second positions, said second opening means operative to traverse said first opening means during movement of said spool from said second position to said first position and operative during said traversing to meter a pilot fuel charge to said outlet means and then a main fuel charge to said outlet means;

cam means having a lobe smoothly increasing on one side and abruptly decreasing on the other side;

means biasing said spool toward said lobe; and means driven at a velocity proportional to engine speed and effecting relative movement between said cam means and said spool in a timed relation with said periodic means, said smoothly increasing side operative to move said spool to said first position at velocities proportional to engine speed while said periodic means is blocking said communicating means, and said abruptly decreasing side and said biasing means operative to move said spool from said first position to said second position at velocities independent of engine speed while said periodic means is unblocking said communicating means, whereby said second opening means traverse said first opening means at velocities independent of engine speed.

33. The metering valve of claim 32, wherein said first opening means includes:

a pilot fuel charge opening and a main fuel charge opening spaced from said pilot fuel charge opening and said second opening means traverses said pilot fuel charge opening and then said main fuel charge opening as said spool moves from said second position to said first position.

34. The metering valve of claim 32, wherein said second opening means includes:

a pilot fuel metering opening and a main fuel metering opening spaced from said pilot fuel metering opening and said pilot fuel metering opening traverses said first opening means and then said main fuel metering opening traverses said first opening means as said spool moves from said second position to said first position.

35. The metering valve of claim 34, wherein said first opening means includes:

a pilot fuel charge opening traversed by said pilot fuel metering opening as said spool moves from said second position to said first position; and a main fuel charge opening traversed by said main fuel metering opening as said spool moves from said second position to said first position and after said pilot fuel charge opening is traversed by said pilot fuel metering opening.

36. The metering valve of claim 35, wherein said main fuel metering opening is positioned between said pilot and main fuel charge openings when said spool is in said first position.

37. A fluid metering valve comprising:

a valve housing having fluid inlet means adapted to be connected to a source of fluid pressure and fluid outlet means;

a valving member disposed for movement in said housing between first and second positions and operative while moving from said second position to said first position to momentarily communicate said inlet means with said outlet means, then momentarily block said communication, and then to again momentarily communicate said inlet means with said outlet means, whereby first and second fluid charges are metered to said outlet means;

first means for moving said valving member from said second position to said first position; and second means operative to move said valving member from said first position to said second position and then operative to release said valving member and allow said first means to move said valving member at velocities independent of said second means, while said first and second fluid charges are being metered to said outlet.

38. The metering valve of claim 37, wherein said second means comprises:

cam means having a lobe smoothly increasing on one side and abruptly decreasing step means on the other side, said smoothly increasing lobe operative to move said valving member from said first position to said second position in response to relative movement between said cam means and said valving member, said step means operative to release said valving member and allow said first means to move said valving member from said second position to said first position at velocities independent of said relative movement.

39. The metering valve of claim 37, wherein said second means comprises:

cam means having a lobe smoothly increasing on one side and abruptly decreasing in first and second steps on the other side, said smoothly increasing lobe operative to move said valving member from said first position to said second position in response to relative movement between said cam means and said valving member, said first step operative to allow said first means to move said valving member a distance sufficient for metering said first charge and then operative to momentarily arrest movement of said valving member, and said second step then operative to allow said first means to move said valving member a distance sufficient for metering said second charge.

40. In a pilot injection system of the type including a source of pressurized fuel, a nozzle for delivering the fuel to a cylinder of an internal combustion engine, means for communicating the source with the nozzle, and periodic means for blocking and unblocking the communicating means in timed relation to the position of a piston in the cylinder, wherein the improvement comprises:

a valve housing having a fuel inlet port connected to said source by said communicating means and a fuel outlet port connected to said nozzle by said communicating means;

a valving member disposed for movement in said housing between first and second positions and operative while moving from said second position to said first position to meter a pilot fuel charge to said outlet port and then a main fuel charge to said outlet port;

first means for moving said valving member from said second position to said first position; and second means operative to move said valving member from said first position to said second position while said periodic means blocks said communicating means and then operative to release said valving member and allow said first means to move said valving member from said second position to said first position while said periodic means unblocks said communicating means and at velocities independent of engine speed while said pilot and main fuel charges are being metered to said outlet port.

41. The metering valve of claim 40, wherein said second means comprises:

cam means having a lobe smoothly increasing on one side and abruptly decreasing step means on the other side, said smoothly increasing lobe operative to move said valving member from said first position to said second position at velocities proportional to engine speed, said step means operative to release said valving member and allow said first means to move said valving member from said second position to said first position at velocities independent of engine speed.

42. The metering valve of claim 40, wherein said second means comprises:

cam means having a lobe smoothly increasing on one side and abruptly decreasing in first and second steps on the other side, said smoothly increasing lobe operative to move said valving member from said first position to said second position at velocities proportional to engine speed, said first step operative to allow said first means to move said valving member a distance sufficient for metering said first charge and then operative to momentarily arrest movement of said valving member, and said second step then operative to allow said first means to move said valving member a distance sufficient for metering said second fuel charge.

* * * * *

UNITED STATES PATENT AND TRADEMARK OFFICE

CERTIFICATE OF CORRECTION

PATENT NO. : 4,064,845

DATED : 12/27/77

INVENTOR(S) : Hansueli Bart

It is certified that error appears in the above-identified patent and that said Letters Patent are hereby corrected as shown below:

Col. 1, line 21: "As" should be --An--.

Col. 2, line 22: "causes" should be --cause--.

Col. 2, line 25: After "piston" insert --speed--.

Col. 6, line 14: "grooves" should be --groove--.

Col. 6, line 20: "tooth" should be --toothed--.

Col. 6, line 45: "70a" should be --70b--.

Col. 8, line 57: Delete --1--.

Signed and Sealed this

Second Day of May 1978

[SEAL]

Attest:

RUTH C. MASON
Attesting Officer

LUTRELLE F. PARKER
Acting Commissioner of Patents and Trademarks